United States Patent [19]

Walter

[11] Patent Number: 4,979,577

[45] Date of Patent: Dec. 25, 1990

[54] FLOW PULSING APPARATUS AND METHOD FOR DOWN-HOLE DRILLING EQUIPMENT

[75] Inventor: Bruno H. Walter, Edmonton, Canada

[73] Assignee: Intech International, Inc., Edmonton, Canada

[21] Appl. No.: 323,624

[22] Filed: Mar. 14, 1989

Related U.S. Application Data

[63] Continuation-in-part of Ser. No. 46,621, May 6, 1987, Pat. No. 4,830,122, which is a continuation of Ser. No. 27,128, Mar. 16, 1987, abandoned, which is a continuation-in-part of Ser. No. 8,963, Jan. 30, 1987, Pat. No. 4,819,745, which is a continuation-in-part of Ser. No. 626,121, Jun. 29, 1984, abandoned.

[51] Int. Cl.[5] ..... E21B 7/24

[52] U.S. Cl. ..... 175/56; 175/243; 175/317; 367/85

[58] Field of Search ..... 175/55, 56, 106, 232, 175/234, 243, 297, 299, 317; 367/85, 83; 166/177

[56] References Cited

U.S. PATENT DOCUMENTS

| | | | |
|---|---|---|---|
| 701,391 | 6/1902 | Pruszkowski | 175/92 |
| 2,287,157 | 6/1942 | Wolff | 175/106 |
| 2,713,472 | 7/1955 | Bodine, Jr. | 175/56 |
| 2,743,083 | 4/1956 | Zublin | 175/56 |
| 2,746,721 | 5/1956 | Moore | 175/317 |
| 2,750,154 | 6/1956 | Boice | 175/106 X |
| 2,780,438 | 2/1957 | Bielstein | 175/92 |
| 3,065,805 | 11/1962 | Martini | 175/56 |
| 3,096,833 | 7/1963 | Bodine | 175/56 |
| 3,105,560 | 10/1963 | Zublin | 175/56 |
| 3,194,325 | 7/1965 | Gianelloni | 175/107 X |
| 3,307,641 | 3/1967 | Wiggins, Jr. | 175/56 |
| 3,346,058 | 10/1967 | Bouyoucos | 175/56 |
| 3,415,330 | 12/1968 | Bouyoucos | 175/56 |
| 3,416,613 | 12/1968 | Henderson | 173/57 |
| 3,431,984 | 3/1969 | Buehler et al. | 175/297 X |
| 3,441,094 | 4/1969 | Galle et al. | 175/56 |
| 3,568,783 | 3/1971 | Chenoweth | 175/92 |
| 3,768,576 | 11/1973 | Martini | 173/73 |
| 3,807,512 | 4/1974 | Pogonowski et al. | 175/106 |
| 3,958,217 | 5/1976 | Spinnier | 367/83 |
| 4,434,863 | 3/1984 | Garrett | 175/321 |
| 4,817,739 | 4/1989 | Jeter | 175/317 X |

FOREIGN PATENT DOCUMENTS

| | | | |
|---|---|---|---|
| 3323774 | 2/1984 | Fed. Rep. of Germany . | |
| 1035202 | 8/1983 | U.S.S.R. | 166/177 |

*Primary Examiner*—Ramon S. Britts
*Assistant Examiner*—David J. Bagnell
*Attorney, Agent, or Firm*—John W. Ross; Robert M. Phipps

[57] ABSTRACT

Flow pulsing apparatus is adapted to be connected in a drill string above a drill bit. The apparatus includes a housing providing a passage for a flow of drilling fluid toward the bit. A valve which oscillates in the axial direction of the drill string periodically restricts the flow through the passage to create pulsations in the flow and a cyclical water hammer effect thereby to vibrate the housing and the drill bit during use. Drill bit induced longitudinal vibrations in the drill string can be used to generate the oscillation of the valve along the axis of the drill string to effect the periodic restriction of the flow or, in another form of the invention, a special valve and spring arrangement is used to help produce the desired oscillating action and the desired flow pulsing action.

14 Claims, 7 Drawing Sheets

FLOW PULSING APPARATUS AND METHOD FOR DOWN-HOLE DRILLING EQUIPMENT

CROSS-REFERENCE TO RELATED APPLICATIONS

This is a continuation-in-part of my co-pending U.S. application Ser. No. 046,621 filed May 6, 1987, (now U.S. Pat. No. 4,830,122 issued May 16, 1989) in turn a continuation of my application Ser. No. 027,128 filed Mar. 16, 1987 (now abandoned), in turn, a continuation-in-part of my co-pending application Ser. No. 008 963 filed Jan. 30, 1987, (now U.S. Pat. No. 4,819,745 issued Apr. 11, 1989) in turn a continuation-in-part of my application Ser. No. 626,121 filed June 29, 1984 (now abandoned).

This invention relates to flow pulsing apparatus and a method for use in down-hole drilling equipment, and in particular to improved apparatus and methods of this type to be utilized in a drill string above a drill bit with a view to securing improvements in the drilling process.

BACKGROUND OF THE INVENTION

In the drilling of deep wells such as oil and gas wells, it is common practise to drill utilizing the rotary drilling method. A suitably constructed derrick suspends the block and hook arrangement, together with a swivel, drill pipe, drill collars, other suitable drilling tools, for example reamers, shock tools, etc. with a drill bit being located at the extreme bottom end of this assembly which is commonly called the drill string.

The drill string is rotated from the surface by the kelly which is rotated by a rotary table. During the course of the drilling operation, drilling fluid, often called drilling mud, is pumped downwardly through the hollow drill string. This drilling mud is pumped by relatively large capacity mud pumps. At the drill bit this mud cleans the rolling cones of the drill bit, removes or clears away the rock chips from the cutting surface and lifts and carries such rock chips upwardly along the well bore to the surface.

In more recent years, around 1948, the openings in the drill bit allowing escape of drilling mud were equipped with jets to provide a high velocity fluid flow near the bit. The result of this was that the penetration rate or effectiveness of the drilling increased dramatically. As a result of this almost all drill bits presently used are equipped with jets thereby to take advantage of this increased efficiency It is worthwhile to note that between 45–65% of all hydraulic power output from the mud pump is being used to accelerate the drilling fluid or mud in the drill bit jet with this high velocity flow energy ultimately being partially converted to pressure energy with the chips being lifted upwardly from the bottom of the hole and carried to the surface as previously described.

As is well known in the art, a rock bit drills by forming successive small craters in the rock face as it is contacted by the individual bit teeth. Once the bit tooth has formed a crater, the next problem is the removal of the chips from the crater. As is well known in the art, depending upon the type of formation being drilled, and the shape of the crater thus produced, certain crater types require much more assistance from the drilling fluid to effect proper chip removal than do other types of craters.

The effect of drill bit weight on penetration rate is also well known. If adequate cleaning of the rock chips from the rock face is effected, doubling of the bit weight will double the penetration rate, i.e. the penetration rate will be directly proportional to the bit weight. However, if inadequate cleaning takes place, further increases in bit weight will not cause corresponding increases in drilling rate owing to the fact that formation chips which are not cleared away are being reground thus wasting energy. If this situation occurs, one solution is to increase the pressure of the drilling fluid thereby hopefully, to clear away the formation chips in which event a further increase in bit weight will cause a corresponding increase in drilling rate. Again, at this increased drilling rate, a situation can again be reached wherein inadequate cleaning is taking place at the rock face and further increases in bit weight will not significantly affect the drilling rate and, again, the only solution here is to again increase the drilling fluid pumping pressure thereby hopefully to properly clear the formation chips from the rock face to avoid regrinding of same. Those skilled in the art will appreciate that bit weight and drilling fluid pressure must be increased in conjunction with one another An increase in drilling fluid pressure will not, in itself, usually effect any change in drilling rate in harder formations; fluid pressure and drill bit weight must be varied in conjunction with one another to achieve the most efficient result. For a further discussion of the effect of rotary drilling hydraulics on penetration rate, reference may be had to standard texts on the subject It should also be noted that in softer formations, the bit weight that can be used effectively is limited by the amount of fluid cleaning available below the bit. In very soft formations the hydraulic action of the drilling fluid may do a significant amount of the removal work.

In an effort to increase the drilling rate, the prior art has provided vibrating devices known as mud hammers which cause a striker hammer to repeatedly apply sharp blows to an anvil, which sharp blows are transmitted through the drill bit to the teeth of the rolling cones. This has been found to increase the drilling rate significantly; the disadvantage however is that both the bit life and mud hammer life are significantly reduced. In a deep well, it is well known that it takes a considerable length of time to remove and replace a worn out bit and/or mud hammer and hence in using this type of conventional mud hammer equipment the increased drilling rate made possible is offset to a significant degree by the reduction in bit and mud hammer life.

The prior art has also provided various devices for effecting pulsations in the flow of drilling fluid to enhance the hydraulic action of the drilling fluid and to induce vibrations in the drill string by virtue of water hammer effect.

My above-noted copending U.S. patent applications Ser. Nos. 008963 and 626,121 (disclosures of which are incorporated herein by reference thereto) disclose improved devices for increasing drilling rate by periodically interrupting the flow to produce pressure pulses therein and a water hammer effect which acts on the drill string to increase the penetration rate of the bit. The flow pulsing apparatus described includes a rotor having blades which is adapted to rotate in response to the flow of drilling fluid through the tool housing. A rotary valve forms part of the rotor and alternately restricts and opens the fluid flow passages thereby to create cyclical pressure variations. The flow passages comprise radially arranged port means in a valve section of the housing with the rotary valve means being arranged to rotate in close co-operating relationship to the port means to alternately open and close the radial ports during rotation.

Because of the fact that the drilling fluid typically contains a substantial portion of gritty material of varying size as well as other forms of debris such as sawdust and wood chips, and since it is not practical to attempt to screen or filter all of this material out of the drilling fluid, all of the above-described rotary valve arrangements are somewhat prone to jamming due to debris binding in the valve surfaces. Accordingly, there is a requirement that a degree of clearance be maintained between the valve surfaces, and in my above-noted copending applications Ser. Nos. 008963 and 626121 various improvements have been incorporated thereby to allow the radial clearances between the valving surfaces to be kept as small as possible while at the same time reducing the incidence of jamming It should be kept in mind, of course, that in order to achieve the maximum water hammer effect, the clearances should be kept as small as possible thereby to achieve the maximum possible conversion of the flow energy of the drilling fluid into a water hammer effect. The structures described in my copending U.S. applications Ser. Nos. 008963 and 626121 require a minimum radial clearance in order to avoid binding and jamming. Hence, it can readily be seen that the total "leakage" area when the valve is "closed" will be equal to the clearance dimension multiplied by the total distance around the valve ports. Since there is a need to keep the total leakage area relatively small, it follows that the total distance around the valve ports must be kept reasonably small as well, resulting in much smaller than optimum port holes which in turn restrict the flow unduly even when the valve is fully open thus creating a substantial pressure drop across the open valve. This restriction of the flow through the fully open valve reduces the overall operating efficiency of the system thus tending to restrict its use for large flow volume situations, i.e large tools using 400–1100 gallons/minute, for reasons which will be readily apparent to those skilled in the art.

My above-noted copending application Ser. No. 046,621 describes improved flow pulsing apparatus adapted to be connected in a drill string above a drill bit and includes a housing providing a passage for a flow of the drilling fluid toward the bit. A turbine is located in the housing and it is rotated during use about an axis by the flow of drilling fluid. A novel valve arrangement operated by the turbine means periodically restricts the flow through the passage to create pulsations in the flow and a cyclical water hammer effect to vibrate the housing and the drill bit during use. This valve means is reciprocated in response to the rotation of the turbine means to effect the periodic restriction of the flow as opposed to being rotated as in the other arrangements described above A cam means is provided for effecting the reciprocation of the valve means in response to rotation of the turbine means. The cam means preferably comprises an annular cam surrounding the axis of rotation of the turbine with cam follower means engaging the annular cam with relative rotation occurring between the follower means and the cam on rotation of the turbine to effect the reciprocation of the valve. The valve means includes a valve member which is mounted for reciprocation along the axis of rotation of the turbine. The axis of rotation, when the flow pulsing apparatus is located in the drill string, extends longitudinally of the drill string in a generally vertical orientation.

By utilizing the reciprocating valve structure described in the above-noted U.S. application 046,621 a substantial restriction of the flow area is theoretically possible thus enabling substantial conversion of flow energy to dynamic pressure energy and achieving a large pressure pulse or water hammer effect. At the same time this novel valving arrangement is capable of providing a large fluid flow area when the valve is open thus reducing head losses in the valve full open position and thus in turn allowing increased throughput of drilling fluid to provide good efficiency. However, it has been noted that there is a tendency for the turbine in the above arrangement to stall if the closure or restriction is made very small to achieve the highest water hammer effect. Stalling is due to the fact that the turbine requires at least some flow to produce rotation; this means that full closure cannot be achieved in practice thus limiting the maximum water hammer effect (WHE) achievable.

SUMMARY OF THE INVENTION

In accordance with the present invention there is provided an improved flow pulsing method and an apparatus incorporating a movable valve member for producing an enhanced water hammer effect. This apparatus eliminates the need for the turbine described in the applications noted above and instead is constructed to set a valve member forming part of a mass-spring system into oscillation in response to the dynamic forces/vibrations arising during a drilling operation and/or by the direct action of the drilling fluid on the mass-spring system thereby to effect intermittent pulsations in the flow thus achieving the desired water hammer effect. Since this novel method and apparatus do not employ a turbine, there is no need to maintain a minimum flow through the flow pulsing apparatus; hence the valve member can close completely during each cycle of oscillatory motion. This gives rise to a substantially enhanced water hammer effect (WHE) as compared with the (WHE) achieved by certain prior art arrangements and the arrangements described in the above-noted patent applications.

In one form of the invention, the valve member is mounted via suitable guide means for reciprocation in the axial direction, i.e. lengthwise of the drill string. A spring is connected to the valve member with the spring and the mass of the valve member preferably being chosen such that the mass spring system has a resonant frequency within the range of frequencies of axial vibration likely to be encountered by the drill string. As described more fully hereafter, the major source of vibration or displacement is the drill bit itself.

In another and more preferred form of the invention, a special spring/mass system is associated with the valve member and the valve member is related to a valve seat so that it moves against the flow direction to the closing position. The arrangement is such that pulsation can occur in response to the action of the drilling fluid on the valve member without the need for drill string oscillation. The shape of the pulses and pulse frequency can be preselected to some degree by altering the mass or spring constant etc. of the spring-mass system. When the frequency of the spring-mass system is chosen to be close to the natural frequency of the rest of the drill string (or the bottom part of the string when isolated by a shock tool or other telescopic member from the string above) the spring-mass system can oscillate in resonance with the drill string (or part of it) with the result being that enormous amounts of energy are transmitted to the bit. The arrangement is also resistant to clogging due to debris and since the valve opens in the flow direction, if the spring breaks the valve merely stays open continually thus permitting drilling to continue (at a slower rate) and deferring a costly trip out of the hole.

Further features of the invention and the advantages associated with same will be apparent to those skilled in the art from the following description of preferred embodiments of the invention when read in conjunction with the accompanying drawings.

BRIEF DESCRIPTION OF THE VIEWS OF DRAWINGS

DESCRIPTION OF THE PREFERRED EMBODIMENTS

Figure 1:
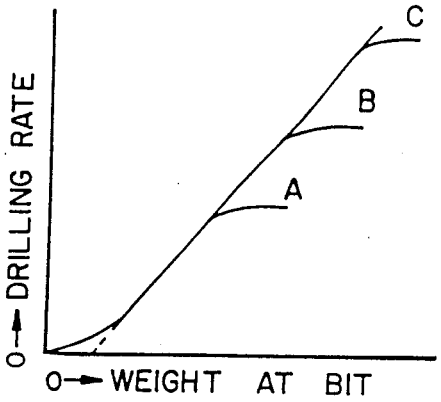
FIG. 1 is a graph illustrating the relationship between drilling rate and bit weight and illustrating the effect that increased cleaning has on drilling rate.

Reference will be had firstly to FIG. 1. As noted previously the effect of bit weight on penetration rate is well known. With adequate cleaning, penetration rate is directly proportional to bit weight. There are some limitations depending of course upon the type of formation being drilled. There is also, in any particular situation, a maximum upper limit to the magnitude of the weight which the bit can withstand.

With reference to FIG. 1, it will be seen that drilling rate is generally proportional to bit weight up to point A where drilling rate drops off rapidly owing to inadequate cleaning which means that formation chips are being reground. From point A, increased cleaning resulted in a proportional increase in drilling rate up to point B where, again, inadequate cleaning was in evidence with a consequent fall off in drilling rate. Again, by increasing the cleaning effect, drilling rate once again became proportional to bit weight up to point C where again, a fall off in drilling rate is in evidence.

FIG. 1 thus demonstrates clearly the importance of effective hole bottom cleaning in obtaining an adequate drilling rate.

It is noted that FIG. 1 has been described mainly in relation to the drilling of harder formations. In softer formations, where the hydraulic action of the drilling fluid does at least part of the work, the relationships shown in FIG. 1 would still apply, although for somewhat different reasons, as those skilled in the art will appreciate.

Figure 2:
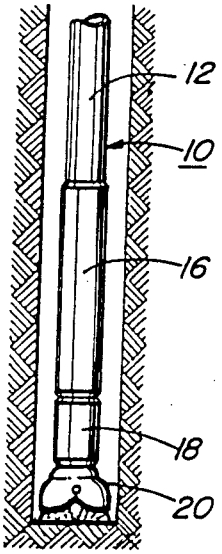
FIG. 2 is a longitudinal section at the bottom of a well bore illustrating apparatus according to the invention connected in the drill string immediately above the drill bit.
Figure 2A:
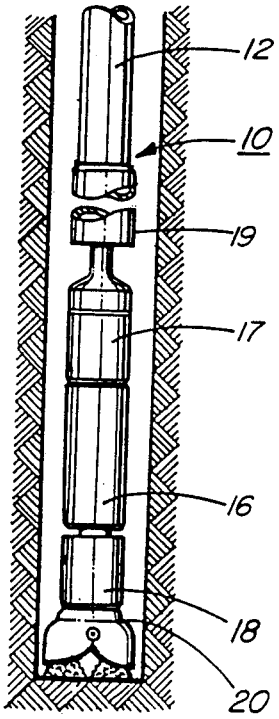
FIG. 2A is a modification of the arrangement shown in FIG. 2.
Figure 3:
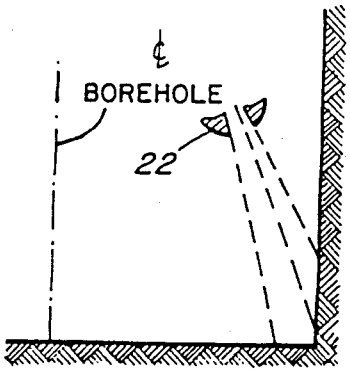
FIG. 3 is a diagrammatic view of the bottom end of the well bore illustrating a jet of drilling fluid being emitted toward the wall and bottom of the bore hole.

Referring now to FIG. 2, there is shown in cross section the lower end portion of a bore hole within which the lower end of a drill string 10 is disposed, such drill string including sections of hollow drill pipe connected together in the usual fashion and adapted to carry drilling fluid downwardly from drill pumps (not shown) located at the surface. The drill string is driven in rotation by the usual surface mounted equipment also not shown. Attached to the lower end of the drill collar 12 via the usual tapered screw thread arrangement is a drilling fluid flow pulsing apparatus 16 in accordance with the invention. To the lower end of the flow pulsing apparatus is connected a relatively short connecting sub 18 which, in turn, is connected via the usual screw threads to a drill bit 20 which may be of conventional design having the usual rolling cone cutters and being equipped with a plurality of cleaning jets suitably positioned to apply streams of drilling fluid on to those regions where they have been found to be most effective in removing chips from the bottom of the well bore. A somewhat modified arrangement is shown in FIG. 2A wherein, above the flow-pulsing apparatus 16, there is provided a drill collar section 17 (to provide extra mass) and above that, a telescoping section 19 of conventional construction which can isolate the upper part of the drill string from the bottom section. The usual rolling cone cutters can be replaced with a percussive bit when the flow pulsing is in a resonant relationship to the rest of the drill string or in reasonance with the lower end of the drill string (when the isolating telescopic member 19 (e.g. a standard bumper sub or shock tool)) is interposed above the flow pulsing apparatus 16 as shown in FIG. 2A. One of such cleaning jets 22 is diagrammatically illustrated in FIG. 3 (the remainder of the drill bit not being shown) thereby to illustrate the manner in which the jet of drilling fluid is directed against the side and bottom portions of the well bore during a drilling operation. The location and arrangement of the jet openings on the drill bit 20 need not be described further since they are not, in themselves, a part of the present invention but may be constructed and arranged in an entirely conventional manner.

Figure 4:
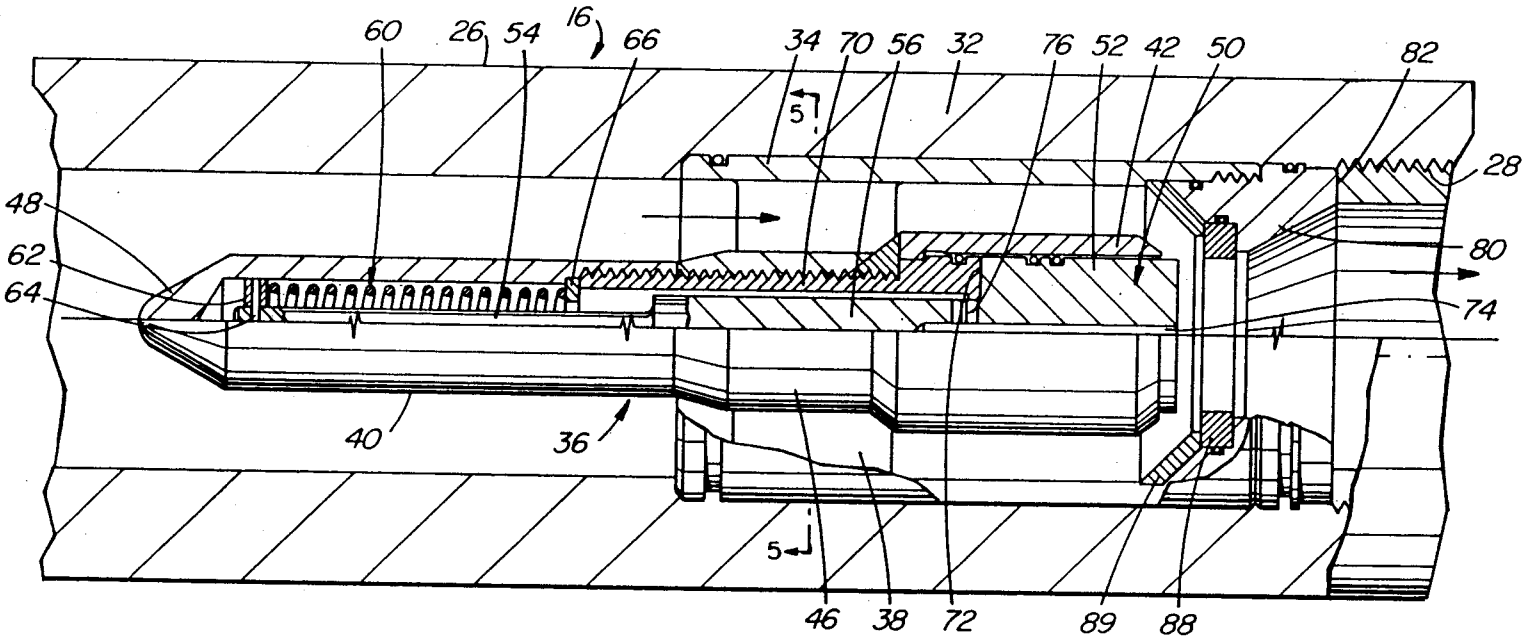
FIG. 4 is a longitudinal half section of apparatus for producing a pulsating flow of drilling fluid in accordance with a first embodiment of the invention.
Figure 5:
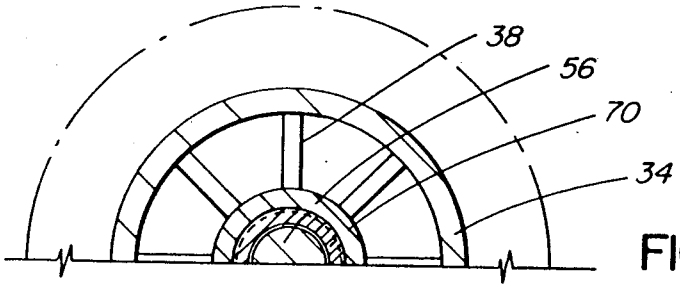
FIG. 5 is a cross-section view taken along line 5—5 of FIG. 4.

Referring now to FIGS. 4 and 5, the first embodiment of the flow pulsing apparatus 16 is shown in detail. Apparatus 16 includes an external tubular casing 26, the wall of which is sufficiently thick as to withstand the torsional and axial forces applied thereto during the course of the drilling operation. Casing 26 is in two sections which are connected together via tapered screw threaded portion 28, with the upper end of the casing having a tapered internally threaded portion (not shown) adapted for connection to a lower end portion of the drill string. The casing 26 also includes a tapered internally threaded lower section (not shown) which may be connected to the drill bit 20.

The casing 26 has a removable cartridge 32 located therein, cartridge 32 containing the valve means to be hereafter described.

The cartridge 32 includes an outer cylindrical shell 34. An elongated valve guide 36 is supported co-axially in shell 34 by means of radial fins 38 interconnected between the interior of shell 34 and the guide 36.

The upstream end 40 of guide 36 is of relatively small diameter; the downstream end is of larger diameter and comprises a sleeve 42 of very hard material, e.g. tungsten carbide, sleeve 42 being connected to intermediate section 46 which, in turn, is fixed to upstream end 40. The upstream end 40 is provided with a smooth conical nose 48 which directs the flow of drilling fluid around the guide 36.

An axially movable valve member 50 is located in the valve guide 36 for axial movement therein and it includes a large head end 52, a small stem portion 54, and an intermediate section 56. A coil compression spring 60 surrounds the stem 54 and its one end bears against a ring 62 affixed to the end of stem 54 by pin 64, while the other end of spring 60 bears against an annular stop 66 fixed to guide upstream end portion 40. An inner annular bearing portion 70 extends between stop 66 and the interior of sleeve 42 and the downstream end of bearing 70 has a shoulder 72 defining the upstream limit of travel of valve member 50.

Valve member 50 has drilled apertures 74, 76 therein allowing the drilling fluid to have access to both sides of the valve member. The hydraulic forces acting on the valve member thus act to balance and to cancel one another out.

The downstream end of shell 34 has an annular valve ring holder 80 seated therein and held in place by abutment against a step 82 in the casing 26. Holder 80 defines conical upstream and downstream faces and has an annular step therein which seats an annular valve ring 88 (and held in place by conical wear ring 89), the valve ring 88 being co-axially arranged with respect to the valve member 50. Hence, as valve member 50 moves axially back and forth within the valve guide 36, the head end 52 moves toward and away from the valve ring 88, thus opening and closing the annular flow passage defined between the head of the valve and the valve ring 88. On the subject of wear it might be noted that the valve ring 88 is preferably of tungsten carbide while the valve member 50 is suitably hard-surfaced to avoid excess wear thereof. (The valve sleeve 42, as previously noted, is preferably of tungsten carbide.) All other components subject to the abrasive drilling fluid are likewise hard-surfaced to reduce wear.

The coil compression spring 60 and the mass of the valve member 50 are chosen so that the mass-spring system defined by the two of them has a resonant frequency within the range of the exciting or forcing frequencies arising from the action of the drill bit on the bore hole bottom. In this regard, reference is had to U.S. Pat. No. 3,307,641 of Mar. 7, 1967 to J. H. Wiggin Jr. which describes in some detail the vertical displacements of the drill string and frequencies thereof arising from the action of the rolling cone cutters on the hole bottom. Conventional rolling cone cutters can be used although special designs can be provided to enhance the displacement as described in the Wiggin Jr. patent. By rotating the drill string at a selected speed, the vertical displacements can be of a frequency corresponding to the natural vibrational frequency of the drill string. Hence the mass-spring system defined by valve member 50 and spring 60 can be forced to oscillate at that same frequency thus generating pressure pulses (due to the water hammer effect) in step with the natural vibrational frequency of the drill string and reinforcing the same. The response of the above mass-spring system will of course be enhanced if its natural frequency equals the forcing frequency, i.e. the frequency of the vertical longitudinal displacements of the drill string. Since the amplitude of the oscillations of the valve member 50 depends to some extent on the relationship between the natural frequency and the forcing frequency, the head 52 of the valve member 50 is of slightly smaller diameter than the aperture in the valve ring 88 so that it can enter into such aperture as the amplitude of the oscillations increase. This permits the valve member to have the desired excursion while eliminating hammering of the valve member on a seat, which hammering could disrupt the free oscillatory motion of the valve member and cause wear of the valve members.

Figure 6:
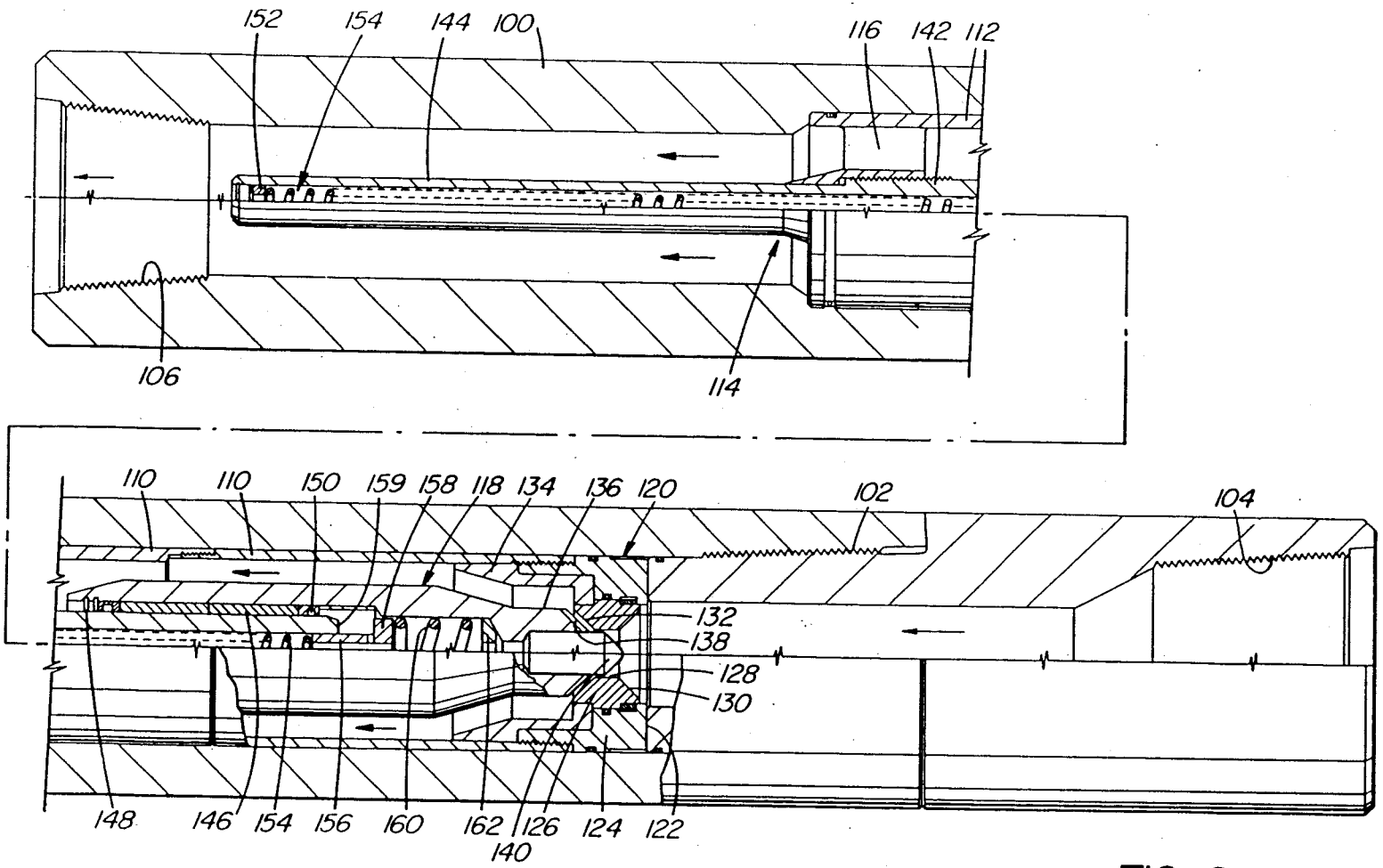
FIG. 6 is a longitudinal half section of a second embodiment of the flow pulsing apparatus.
Figure 6A:
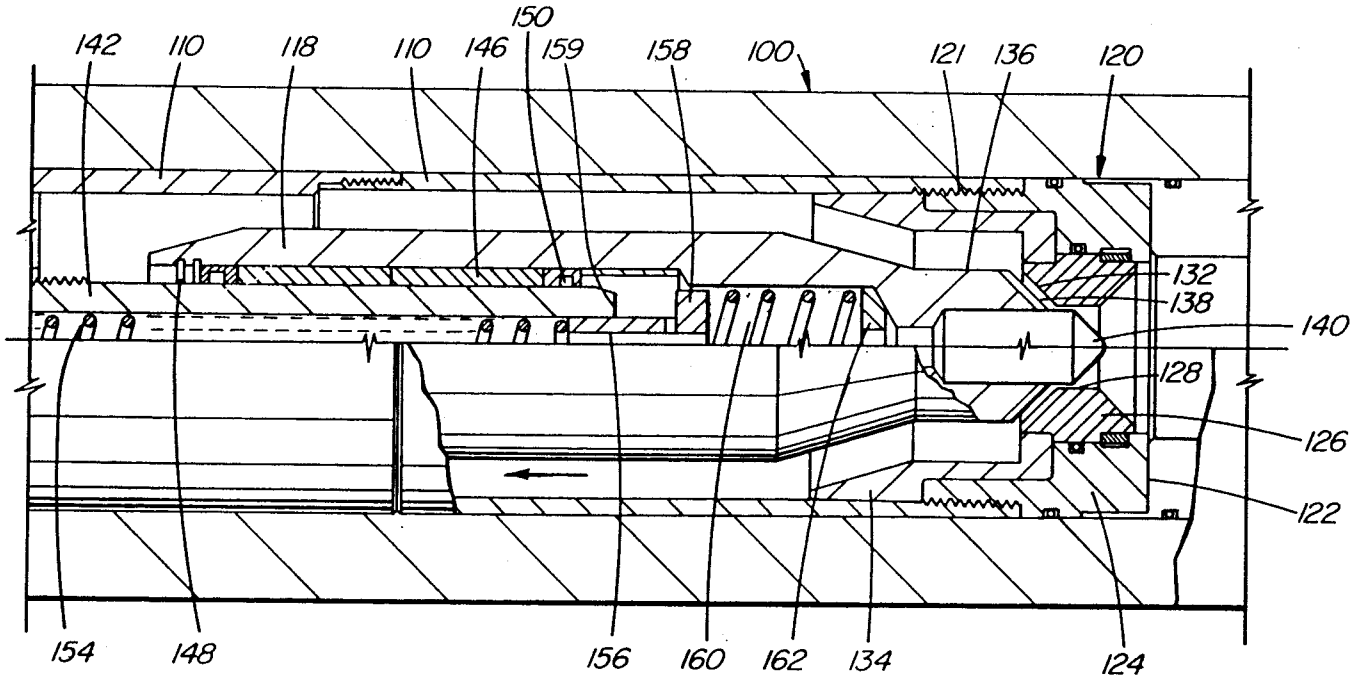
FIG. 6A is an enlarged view of a portion of FIG. 6.

In the embodiment of the invention shown in FIG. 6 and 6A (which is a more preferred form of the invention), the flow pulsing apparatus includes an external casing 100 as before, in two sections, connected by screw threaded portion 102, the upper end having internally tapered threaded portion 104 adapted for connection to the lower end of a drill string (not shown) while the lower internally threaded portion 106 may be connected to a drill bit (not shown) via a connecting sub.

The casing 100 has a removable cartridge 110 therein which contains the valve means to be hereafter described. Cartridge 110 includes an outer cylindrical shell 112 in which an elongated valve guide assembly 114 is co-axially supported by means of several radial fins 116 interconnected between the interior of shell 112 and guide assembly 114. An axially movable valve member 118 is slidably mounted on the upstream end of guide assembly 114 for movement toward and away from valve seat assembly 120 located in the upstream end of cartridge 110 and held in place by virtue of mating screw threads 121 on both the seat assembly 120 and the cartridge 110. An annular flow passage is defined between the valve member 118, guide assembly 114, and the interior of the shell.

Valve seat assembly 120 includes an annular ring holder 124 which butts up against the step 122. Valve ring 126 seats in the ring holder and defines a central throat 128 and opposed, conical, upstream and downstream faces 130, 132, the downstream face 132 defining a valve seat. Valve ring 126 is of very hard material, preferably of tungsten carbide, and is held in place by an annular step on the holder 124 and by an annular valve ring holder 134.

The upstream end of valve member 118 includes a tapered section leading to a reduced diameter portion 136 which, in turn, leads into a frustro-conical valve face 138 which cooperates with face 132 of valve ring 126 to prevent flow through the valve when the valve member 118 is at the upper limit of its travel. The upstream end of valve member 118 also includes an axially disposed valve tip 140 which extends into the throat 128 of the valve ring when the valve member 118 approaches the closed position. The valve tip is of very hard material, e.g., tungsten carbide, and has a rounded conical nose to meet and divert the flow around the valve member 118 when the latter is at least partly open.

Valve tip 140 acts to prevent heavy impact or hammering between the above-noted value faces 132 and 138, which impacts would shorten valve life span. Tip 140 meets the incoming flow and by virtue of its close but non-binding fit in the throat of the valve ring 126, the water hammer effect (WHE) is achieved and equilibrium (to be described later) is reached in the absence of heavy hammering contact between those faces 132, 130 thus increasing valve life. This is a significant factor especially when it is considered that the frequency of oscillation of the valve body 118 is likely to be somewhat greater than 20 Hertz.

Returning now to the guide assembly 114, the latter includes a tubular upstream barrel portion 142 which communicates with a downstream elongated tubular spring holder 144. A bearing sleeve 146 which is preferably of low friction plastics material, e.g., nylon, slidably surrounds the barrel and is fixed to the interior bore 148 of valve member by suitable lock rings, there being a rubber wiper ring 150 at each end of this sleeve, which rings bear on the outer (polished) surface of barrel 142 to help clean away grit, etc., thus allowing the valve member 118 to reciprocate freely in the axial direction along the barrel.

The spring holder 144 has a spring stop ring 152 at the downstream end thereof against which an elongated first coil spring 154 bears. This spring 154 extends all the way to the upstream end of the barrel 142 and makes contact with an axially movable annular spring support 156, the latter having a tubular portion which fits freely into the interior of the barrel 142 and against which the upstream end of spring 154 bears; (the first coil spring has a relatively low spring constant). Spring support 156 is axially movable relative to both the barrel 142 and the valve member 118 and it has an annular flange 158 at its upstream end.

A second relatively short spring 160 (of relatively high spring constant) bears at its one end against the flange 158 of spring support 142 and at its other end against a ring 162 which is fixed to the upper interior end of the bore in the valve member 118. As the valve member 118 moves downwardly to open the valve, the first spring 154 (of lower spring constant) is gradually compressed as the spring support 156 moves along the barrel until the flange 158 contacts the upper terminal end 159 of the barrel. Further downward movement of the valve member 118 causes compression of the second spring 160 (of high spring constant). The several parts are dimensioned such that the total stroke length of the valve member 118 is relatively short (e.g., less than one inch) in a typical case. In operation, to be described later, most of this movement results in compression of the first spring 154 while only a small amount (if at all) of this motion acts to compress the second spring 160.

Some typical dimensions will be given to help illustrate the operation of the invention, it being realized that these are not limiting on the scope of the invention but are given by way of example only:

| | |
|---|---|
| A. Weight (mass) of valve member (118) | 25 lbs. (11.3 kg) |
| B. Length of first spring (154) in the installed extended state | 18 ins. (45.7 cm) approx. |
| C. Length of second spring (160) in the installed extended state | 2 ins. (5.1 cm) approx. |
| D. Spring constant of first spring (154) | 20 lbs./in (35 Nt/cm) approx. |
| E. Spring constant of second spring (160) | 1500 lbs./in (2635 Nt/cm) approx. |
| F. Axial preloading of springs (154 & 160) in the installed extended condition | 80–85 lbs (356–378 Nt) approx. |
| G. Diameter of throat (128) defined by valve ring (126) | 1 in (2.54 cm) |
| H. Length of stroke of valve member | 1 in (2.54 cm) max. (approx.) |
| (i) Amount of compression of spring (154) | (¾) in (1.92 cm) max. (varies) |
| (ii) Amount of compression of spring (160) | (¼) in (.64 cm) max. (varies) |
| I. Pulse frequency at equilibrium | (25) Hertz approx. |

In the operation of the apparatus of FIG. 6, the flow of drilling fluid is accelerated as it moves downwardly through the throat 128 defined by the valve ring 126. At the same time, the pressure in this area is reduced due to the Bernoulli effect. The serially arranged springs 154 and 160 urge valve member 118 and its valve face 138 and tip 140 against the direction of the flow, the preloading in these springs being slightly greater than the dynamic pressure arising from the flow. Hence, the valve member 118 tends to move in the closing direction until the flow is restricted and the pressure on the upstream side of the valve increases, such increased pressure acting on the valve member 118 to cause it to open. At this point, it is noted that the energy (work done on the valve by the flow as it opens) is stored in the mass/spring system during opening and is used to overcome the pressure rise above the valve during the closing of the valve. When the valve closes or severely restricts the flow the (WHE) is achieved. The increased pressure above the valve acts on the valve spring-mass system and all the energy (work) required to drive the mass-spring system downwards is stored in the mass-spring system for use in the next valve closing cycle. The large mass of the valve member acts as a "flywheel" to store energy during opening of the valve and this energy is in turn used during closing of the valve.

The valve closing force is thus proportional to the amount of energy (momentum) that can be stored in the spring-mass system during opening of the valve and the original preload on the springs. The result after start-up is that on each successive closing cycle, the closing force is slightly greater than before thus resulting in a progressively greater restriction of the valve opening and thus producing higher pressure pulses due to the water hammer effect (WHE). This build-up continues until:

(a) equilibrium is reached; and (b) valve member (face 138) comes in contact with face 132 resulting in maximum flow restriction and maximum (WHE).

Tests have confirmed the above statements.

The reasons for making first spring 154 of low spring constant and second spring 160 of high spring constant will now be described. The terms "high" and "low" are relative terms. The following discussion will help to clarify what is meant by these terms and will enable those skilled in the art to select spring constants for the springs which will accomplish the desired result without undue experimentation for any given situation.

Figure 7:
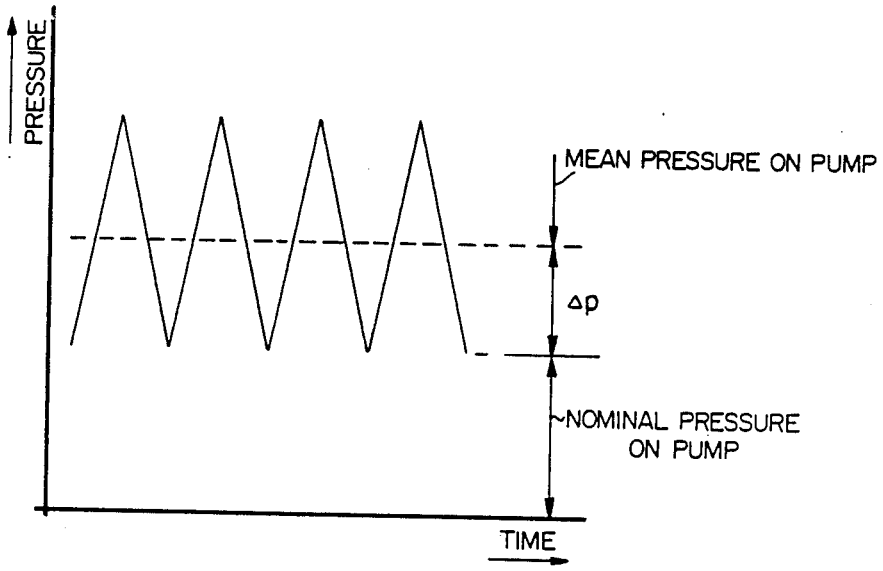
FIG. 7 is a hypothetical pressure—time plot taken above the valve means.

If the spring constant of spring 154 were made "high", the movement of the valve member 118 down from the closed position would be very limited (i.e. the stroke would be short) and all energy from the valve opening pulse would be absorbed quickly and the valve member would move quickly back to the valve closed position. The graph of the resulting pressure pulse (WHE) would be as in FIG. 7. The pressure differential to operate the tool would be relatively high (a thousand p.s.i. (7000 kPa) or more) and the mean pump pressure (MPP) woud be excessively high thus resulting in excessively high pumping power requirements.

On the other hand, when the constant of spring 15A is made low, energy storage in the mass spring system during the opening stroke will take place over a much longer stroke than in the previous case thus resulting in a longer time period that the tool is fully open. The graph of the resulting pressure pulses (WHE) appears as in FIG. 8. It can be seen from this that by using a low spring constant for spring 154 the pulses are well separated or spaced out. The pressure difference (200 psi 1380 kPa or so) to operate the tool is low and the mean pump pressure (MPP) is also lower, thus reducing pumping power requirements and a relatively low frequency pulse rate (e.g. 20–27 Hertz) is provided.

Figure 8:
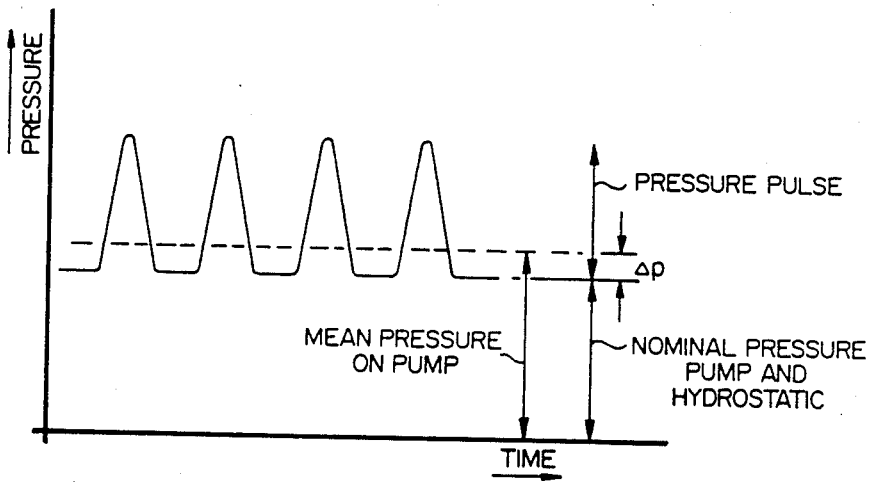
FIGS. 8 and 9 are pressure—time plots taken above and below the valve means of the embodiment of FIG. 6.
Figure 9:
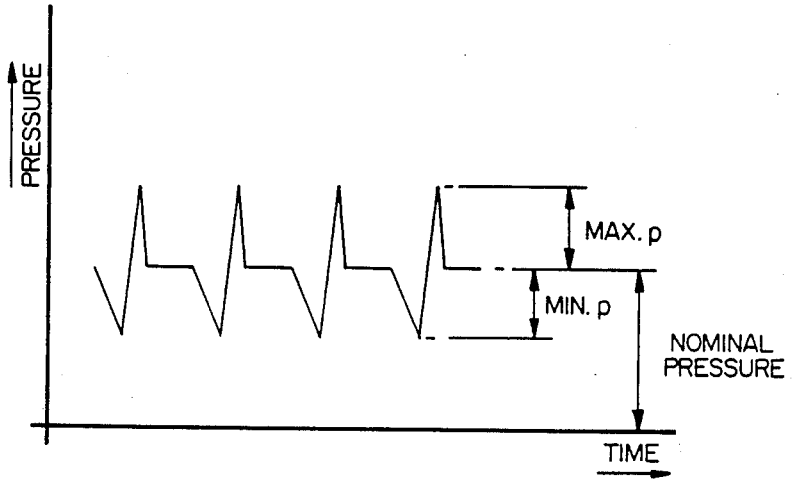
Figure 10:
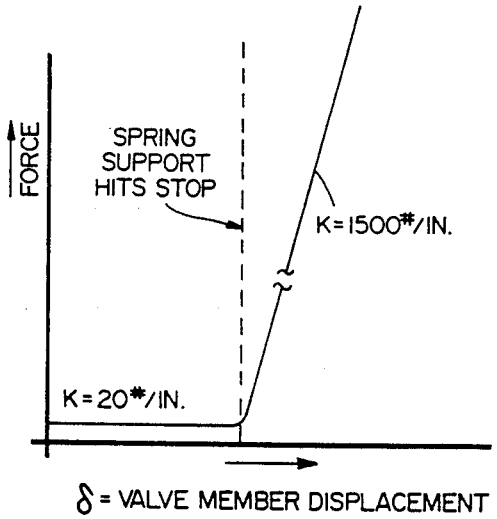
FIG. 10 is a plot of spring force—valve member displacement for the FIG. 6 embodiment.

The combined effects of the two springs 154 and 160 will now be described. In order to further accelerate the return of the valve member 118 to the closed position once separation of pulses has been achieved by use of the low spring constant spring 154, use is made (in the FIG. 6 embodiment) of the high spring constant spring 160. This spring 16 is effectively activated toward the end of the opening stroke of valve member 118 when the flange 158 on movable spring support 156 engages with the top end 159 of the barrel 142 on which the valve member is mounted. Once this second spring 160 starts compressing during the latter part of the stroke of the valve member, all remaining energy from the opening impulse is stored over a very short portion of the stroke and the valve member is returned more quickly up to the closed position In other words, the use of the high spring constant spring 160 creates greater acceleration of the valve member 118 toward the closing position thus resulting in a somewhat higher pulse frequency while at the same time the separation of the pulses and the advantages associated therewith, e.g , lower pressure differential and (MPP) as outlined above in connection with FIG. 8 are maintained.

It is not easy to define with precision the preferred relation between the spring constants of the two springs 154 and 160. In the example given above, the ratio of the high to the low spring constant is 1500 lb/in (2625 Nt/cm) : 20 lb/in (35 Nt/cm) or 75. This ratio can be varied substantially, e.g., from 50 to 90 and possibly as much as 25 to 100 depending on the precise application. Hence, the expressions "high" and "low" spring constants are used here to describe the fact that the constant of one spring can be many times higher, (in most cases several order of magnitudes higher), than that of the other spring It is also noted here that the second spring can be dispensed with altogether and a further embodiment to be described hereafter omits the second spring.

In common with the first embodiment of the invention described in connection with FIGS. 4 and 5 it is possible to operate the embodiment of FIG. 6 in a resonant mode if the natural frequency of the valve spring-mass system is made to match the natural frequency of the drill string or the natural frequency of a bottom end of a drill spring that is isolated from the upper end of the drill string by a telescopic member, shock sub or the like (FIG. 2A). However, the embodiment of FIG. 6 need not be used with a bit capable of producing significant vertical displacements of the drill string, e.g., it is capable of pulsating on its own independently of any oscillation of the drill string. When used in a drill string which is vibrated axially by the bit, the embodiment of FIG. 6 would be self-starting in the sense that it would begin to pulse the flow independently; however, once the suspended mass of the drill string (e.g., drill bit, flow pulsing apparatus and male spline of a stock tool, if present) begin to oscillate, then the mass/spring system defined by the valve member 118 and its springs will begin to oscillate and the whole oscillating assembly can be made to oscillate in resonance.

It can hence be seen that the embodiment of FIG. 6 is more versatile than the first embodiment (FIGS. 4 and 5). It (the FIG. 6 version) is also less prone to jamming or choking as a result of debris in the flow of drilling fluid (mud) since the valve member closes in a direction opposite to the flow direction and any particles wedging between the valve faces, etc., on one closing cycle are usually relieved and swept away on the next opening cycle.

Figure 11:
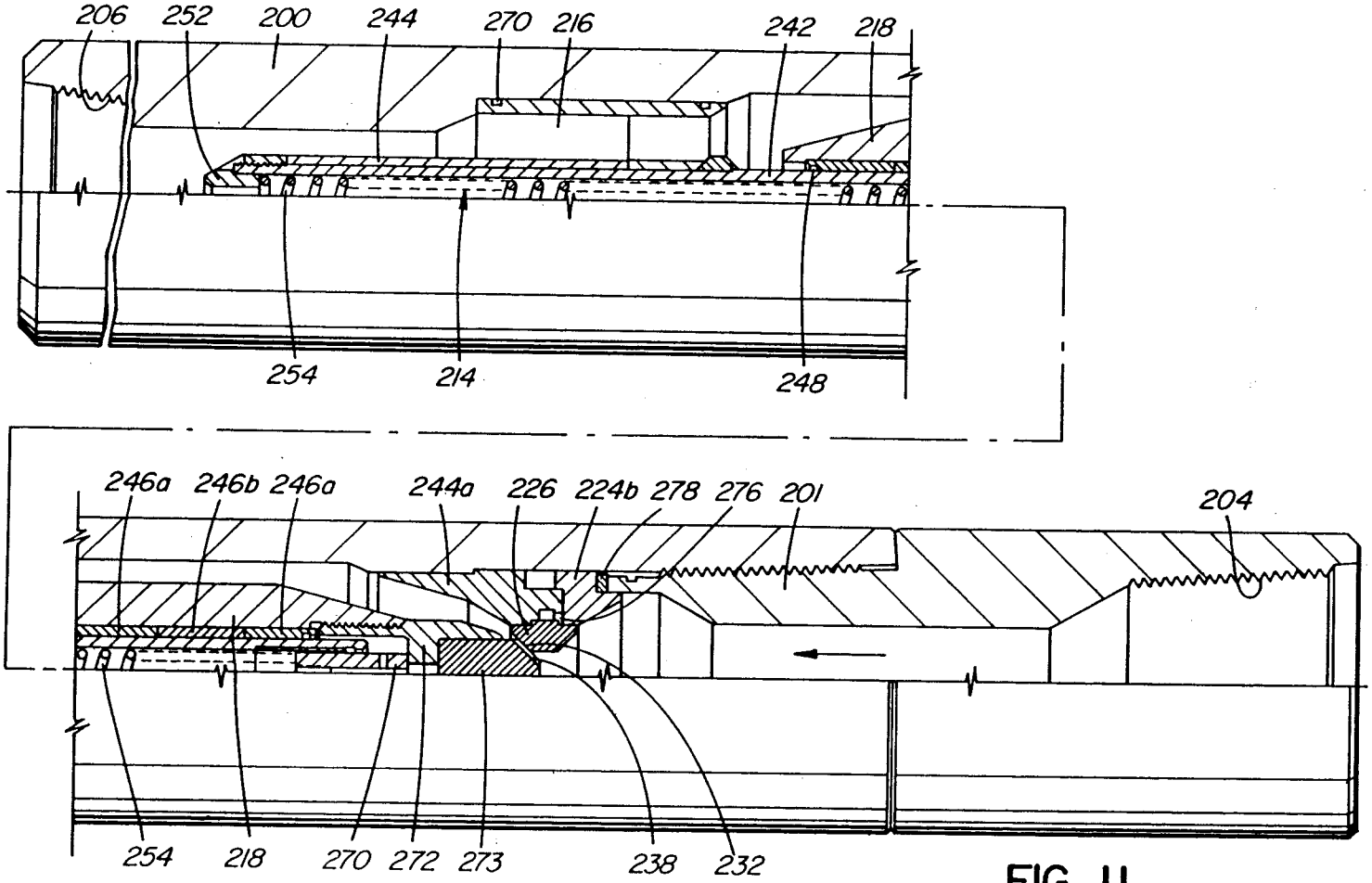
FIG. 11 is a longitudinal half section of a third embodiment of the apparatus, similar to the embodiment of FIG. 6 but of somewhat simplified form.

The embodiments of FIG. 11 is similar to the embodiment of FIG. 6 and includes a casing 200 as before with internally threaded upstream and downstream portions 204 & 206. A guide and support assembly 214 includes an elongated barrel 242 supported by sleeve 270, radial fins 216 and barrel holder 244. A massive valve member 218 (including its upstream nose sections 272, 273) is mounted for reciprocation on the barrel 242 as before via bronze or plastic brushings **246*a* and intermediate bronze brushing 246*b***.

An elongated spring 254 extends within the barrel 242 from downstream spring stop 252 up to an internal sleeve 270 which is fixed to the forward end section 272 of valve member 218 and it slides within the end of barrel 242 as the valve member reciprocates under the influence of the forces described previously.

The valve ring 226 is mounted in an annular recess defined by the two-part ring holder **224*a* and 224*b*. A small amount of clearance in the axial direction is provided between the valve ring 226 and the two-part valve holder 224(*a*&*b*). A rubber shock absorbing ring 278 is provided between the holder portion 224*b* and a step defined by the upstream casing portion 201. Hence, during operation, as the valve member 218 moves upstream and the valve faces 232, 238 begin to close on each other the valve ring 226 moves upstream against the hydraulic pressure that builds up above the valve; after this clearance has been taken up, impact forces between the valve faces 232, 238 are absorbed in part, by the rubber shock absorbing ring 278**.

The embodiment of FIG. 11 requires only a single spring 254 and the spring mass-system defined by it and the valve member 218 function as described above in connection with the FIG. 6 embodiment except that the frequency of operation is somewhat lower owing to the absence of the second (high spring constant) spring. The embodiment of FIG. 11 may in fact be the preferred embodiment for many applications.

During operation of the embodiments described above, the pulsating pressurized flow being applied to the cleaning nozzles or jets of the drill bit provides greater turbulence and greater chip cleaning effect than was hitherto possible thus increasing the drilling rate in harder formations. In softer formations where the eroding action of the drill bit jets has a significant effect, the pulsating, high turbulence action also has a beneficial effect on drilling rate. By making use of the water hammer effect, these high peak pressures are attained without the need for applying additional pumping pressure at the surface thus meaning that standard pumping pressures can be used while at the same time achieving much higher than normal maximum flow velocities and pressures at the drill bit nozzles.

In the embodiments described above, owing to the water hammer effect created as a result of the pulsating flow of drilling fluid, mechanical vibrating forces will be applied to the flow pulsing apparatus which will act in the direction of the drill string axis, which pulsing or vibrating action will be transmitted to the drill bit. This pulsating mechanical force on the drill bit complements the pulsating flow being emitted from the drill bit jet nozzles thereby to greatly enhance the effectiveness of the drilling operation, i.e. to increase the drilling rate.

I claim:

1. Apparatus for effecting pulsations in a flow of drilling fluid through a drill string whereby to create a cyclical water hammer effect in said drill string, and comprising:

means defining a passage for flow of drilling fluid;

a valve member located in the flow passage and adapted for oscillating motion in a direction axially of the drill string when in use;

means guiding and supporting said valve member for oscillating motion in the axial direction;

spring means engaging said valve member and adapted to be extended and retracted as the valve member oscillates; said valve member and spring together defining a spring-mass system adapted for oscillation in response to dynamic forces acting thereon during use;

means defining an axially disposed throat through which, in use, drilling fluid passes toward a drill bit;

said valve member including a portion cooperative with said throat to cyclically restrict or interrupt the flow therethrough as the valve member oscillates without disrupting the oscillation thereof; and wherein said valve member has a passage therein allowing hydrosatic fluid pressures to equalize on upstream and downstream sides of said valve member such that the latter is hydraulically neutral.

2. Apparatus according to claim 1 wherein said means for guiding and supporting the valve member includes an elongated chamber, said valve member having an elongated stem portion arranged for free axial movement in said chamber, said spring means being a coil spring connected to said stem portion and surrounding the same and located in the elongated chamber.

3. Apparatus according to claim 2 wherein said portion of the valve member co-operative with said throat comprises an enlarged head portion, a portion of which is slidably located within said elongated chamber.

4. A rotary percussive drill string assembly comprising:

an elongated tubular drill string having a drill bit capable of imparting axial vibratory displacements to the drill string on rotation of the drill bit against a borehole bottom, said drill string being capable of conducting a flow of drilling fluid axially therealong toward said drill bit to clear away cuttings and the like;

said drill string assembly having therein, above said bit, an apparatus for effecting pulsations in the flow of drilling fluid through the drill string whereby to create a cyclical water hammer effect in said drill string, and including:

means defining a passage for the flow of drilling fluid;

a valve member located in the flow passage and adapted for oscillating motion in a direction axially of the drill string when in use;

means guiding and supporting said valve member for oscillating motion in the axial direction;

spring means engaging said valve member and adapted to be extended and retracted as the valve member oscillates; said valve member and spring together defining a spring-mass system adapted for oscillation in response to dynamic forces acting thereon during use;

means defining an axially disposed throat through which, in use, drilling fluid passes toward the drill bit;

said valve member including a portion cooperative with said throat to cyclically restrict or interrupt the flow therethrough as the valve member oscillates without disturbing the oscillation thereof;

said spring-mass system defined by the spring means and valve member having a resonant frequency within the range corresponding to the frequency of the axial vibratory motion of the drill string induceable by said drill bit during a drilling operation thus to effect periodic pulsations in the flow of fluid passing along the drill string and a resulting periodic water hammer effect creating periodic axial forces on the drill bit to enhance the drilling rate.

5. A drill string assembly according to claim 4 wherein said means for guiding and supporting the valve member includes an elongated chamber, said valve member having an elongated stem portion arranged for free axial movement in said chamber, said spring means being a coil spring connected to said stem portion and surrounding the same and located in the elongated chamber.

6. A drill string assembly according to claim 5 wherein said portion of the valve member co-operative with said throat comprises an enlarged head portion, a portion of which is slidably located within said elongated chamber.

7. A drill string assembly according to claim 4 wherein said valve member has a passage therein allowing hydrostatic fluid pressures to equalize on upstream and downstream sides of said valve member such that the latter is hydraulically neutral.

8. A method of drilling a well comprising rotating within a borehole an elongated tubular drill string having a drill bit which imparts axial vibratory displacement to the drill string as the drill bit rotates against the borehole bottom, and passing drilling fluid through said drill string to said drill bit to clear away cuttings, and providing in said drill string a flow pulsing apparatus including a housing providing a passage for a flow of drilling fluid toward the bit, and valve means for periodically restricting the flow through said passage to create pulsations in said flow and a cyclical water hammer effect to vibrate the housing and the drill bit during use, said valve means including a valve member located in the flow passage and forming a part of a mass-spring system supported and arranged for oscillation whereby oscillation of the valve member is effected by virtue of the vibratory displacement of the drill string thus causing pulsations in the flow of drilling fluid and a resulting periodic water hammer effect which, in turn, creates periodic forces on the drill bit to enhance the drilling rate.

9. Flow pulsing apparatus adapted to be positioned in a drill string above a drill bit and including a housing providing a passage for a flow of drilling fluid toward the bit, and valve means for periodically restricting the flow through said passage to create pulsations in said flow and a cyclical water hammer effect to vibrate the drill string and the drill bit during use, said valve means including a valve member, means guiding and supporting said valve member for oscillation along an axis, with said axis of oscillation, when said apparatus is located in a drill string, extending longitudinally of the drill string, and spring means associated with said valve member and defining therewith a spring-mass system which oscillates during use to effect said periodic restriction of the flow, said valve means for periodically restricting the flow being arranged such that in use, the oscillating valve member moves (a) axially opposite to the flow direction toward a flow restricting of closed position and (b) axially in the flow direction toward an open or non-restricting position; said spring-mass system being arranged such that said valve member is moved toward the flow restricting or closed position by the energy stored in the spring-mass system during the previous opening movement of the valve member, said valve member being exposed to the flow of drilling fluid during use and responding to the direct action of the fluid forces thereon during use; and wherein said valve means comprises an elongated valve member having an interior bore therein, and said guiding and supporting means comprising an elongated guide fixed to said housing and disposed within the interior bore in the valve member such that the latter is slidable thereon during its stroke of travel, and said spring means extending, in part, axially along said guide and acting on said valve member to urge the latter toward a closed or flow restricting position.

10. Apparatus according to claim 9 wherein said spring means comprises a pair of springs arranged in series, a first one of said springs being of a relatively low spring constant to provide for a desired natural rate of frequency of oscillation while the second one of said springs is of a relatively high spring constant and is arranged to be activated during the latter part of the opening stroke of the valve member to effect a relatively rapid return of the valve member to the flow restricting position whereby to provide separation of the pulsations in the flow.

11. Apparatus according to claim 10 including an axially movable spring support located at an upstream end of the guide and interPosed between the first and second springs, said spring support cooperating with said guide to allow compression of the first spring during a first major portion of the opening stroke of the valve member and compression only of said second spring during a second minor portion of said stroke.

12. Apparatus according to claim 9 wherein said spring means comprises first and second springs arranged in series along said axis of oscillation, said second spring having a spring constant substantially higher than that of the first spring, and means cooperating with said first and second springs to (a) allow compression of the first spring during a first portion of the movement of the valve member in the closing direction and (b) allow compression of the second spring only during a second portion of the movement of the valve member in the closing direction.

13. Flow pulsing apparatus adapted to be positioned in a drill string above a drill bit and including a housing providing a passage for a flow of drilling fluid toward the bit, and valve means for periodically restricting the flow through said passage to create pulsations in said flow and a cyclical water hammer effect to vibrate the drill string and the drill bit during use, said valve means including a valve member, means guiding and supporting said valve member for oscillation along an axis, with said axis of oscillation, when said apparatus is located in a drill string, extending longitudinally of the drill string, and spring means associated with said valve member and defining therewith a spring-mass system which oscillates during use to effect said periodic restriction of the flow, said valve means for periodically restricting the flow being arranged such that in use, the oscillating valve member moves (a) axially opposite to the flow direction toward a flow restricting or closed position and (b) axially in the flow direction toward an open or non-restricting position; wherein said valve means includes an annular ring fixed to said housing and surrounding said axis of oscillation, said valve member being arranged such that an annular flow passage is defined between itself and said ring in the open position of said valve member, said valve member, in use, oscillating along the axis of oscillation toward and away from said annular ring such that the area of the annular flow passage defined between said ring and valve member varies from a maximum to a minimum, and wherein both said valve member and said valve ring define mating annular valve seats, said valve ring defining a circular throat portion and said valve member having a tip portion thereon which enters into the throat before said valve seats contact each other whereby forces arising from the dynamic pressure of the flow of drilling fluid act on said tip portion to reduce the speed of movement of the valve member and any impact between the valve faces.

14. Apparatus according to claim 13 in combination with a drill string, the drill string having a telescoping member or shock tool located above said apparatus.

* * * * *